US011697955B2

(12) United States Patent
Vanini et al.

(10) Patent No.: US 11,697,955 B2
(45) Date of Patent: Jul. 11, 2023

(54) HINGE FOR DOORS

(71) Applicant: NUOVA STAR S.p.A., Zola Predosa (IT)

(72) Inventors: Marco Vanini, Zola Predosa (IT); Luca Vanini, Zola Predosa (IT)

(73) Assignee: NUOVA STAR SPA, Zola Predosa (IT)

( * ) Notice: Subject to any disclaimer, the term of this patent is extended or adjusted under 35 U.S.C. 154(b) by 0 days.

(21) Appl. No.: 17/548,154

(22) Filed: Dec. 10, 2021

(65) Prior Publication Data

US 2022/0186537 A1 Jun. 16, 2022

(30) Foreign Application Priority Data

Dec. 16, 2020 (IT) ..... 102020000031142

(51) Int. Cl.
*E05F 1/08* (2006.01)
*E05D 7/06* (2006.01)
*E05F 1/12* (2006.01)

(52) U.S. Cl.
CPC ..... *E05D 7/06* (2013.01); *E05F 1/1261* (2013.01); *E05Y 2201/492* (2013.01);
(Continued)

(58) Field of Classification Search
CPC ... F16F 15/03; F16F 6/00; F16F 6/005; F24C 15/02; F24C 15/023; E05F 1/1276; E05F 1/1292; E05F 1/1261; E05F 1/1253; E05F 3/02; E05F 3/10; E05Y 2201/41; E05Y 2201/412; E05Y 2201/414;
(Continued)

(56) References Cited

U.S. PATENT DOCUMENTS 4,658,473 A 4/1987 Shema
4,817,240 A * 4/1989 Sovis, Jr. ..... F24C 15/023 16/322
(Continued)

FOREIGN PATENT DOCUMENTS

DE 102010040952 A1 3/2012
EP 0692598 A1 * 1/1996
EP 1055882 A2 * 11/2000 ..... E05D 11/10
(Continued)

OTHER PUBLICATIONS

Italian Search Report dated Sep. 7, 2021 from counterpart Italian Patent Application No. 102020000031142.

*Primary Examiner* — Chuck Y Mah
(74) *Attorney, Agent, or Firm* — Shuttleworth & Ingersoll, PLC; Timothy Klima

(57) ABSTRACT

A hinge for doors of domestic appliances, comprising a first element and a second element pivoted to each other and movable relative to each other in tilting fashion, the first and second elements being fixable one to a frame and the other to a door of an electrical household appliance, for making the door movable with respect to the frame between a closed position and an open position, a lever for connection between the first and the second closing elements, an elastic element connected to the lever and designed to generate with its own deformation a force of elastic adjustment designed to compensate at least partially the weight force of the door during the opening or closing of the door, means for adjusting the intensity of the elastic reaction force.

11 Claims, 5 Drawing Sheets

(52) U.S. Cl.
CPC ... *E05Y 2201/638* (2013.01); *E05Y 2201/686* (2013.01); *E05Y 2201/696* (2013.01); *E05Y 2600/634* (2013.01); *E05Y 2800/22* (2013.01); *E05Y 2900/20* (2013.01); *E05Y 2900/302* (2013.01); *E05Y 2900/304* (2013.01); *E05Y 2900/308* (2013.01)

(58) Field of Classification Search
CPC ..... E05Y 2201/416; E05Y 2201/40; E05Y 2201/46; E05Y 2900/30; E05Y 2900/302; E05Y 2900/304; E05Y 2900/308; E05Y 2900/20; E05Y 2201/492; E05Y 2201/638; E05Y 2201/686; E05Y 2201/696; E05Y 2201/716; E05Y 2201/722; E05Y 2600/634; E05Y 2800/22; E05D 11/1064; E05D 3/18; E05D 3/122; E05D 7/06; Y10T 16/5383
See application file for complete search history.

(56) References Cited

U.S. PATENT DOCUMENTS

| | | | | |
|---|---|---|---|---|
| 8,985,717 | B2 | 3/2015 | Marzorati | |
| 2006/0130276 | A1* | 6/2006 | Clark | E05F 1/1215 16/299 |
| 2011/0247176 | A1* | 10/2011 | Vanini | E05F 1/1058 16/297 |
| 2015/0145397 | A1* | 5/2015 | Chin | F24C 15/023 312/319.3 |
| 2015/0345203 | A1* | 12/2015 | Vanini | E05F 3/14 16/68 |
| 2017/0260785 | A1* | 9/2017 | Vanini | E05F 1/1058 |
| 2018/0216832 | A1* | 8/2018 | White | E05F 5/02 |

FOREIGN PATENT DOCUMENTS

| | | | | |
|---|---|---|---|---|
| EP | 1602883 | A2 * | 12/2005 | A47L 15/4261 |
| EP | 3960976 | A1 * | 3/2022 | |

* cited by examiner

HINGE FOR DOORS

This application claims priority to Italian Patent Application IT 102020000031142 filed Dec. 16, 2020, the entirety of which is incorporated by reference herein.

DESCRIPTION

This invention relates to a hinge for doors.

In particular, the invention relates to a hinge for doors of domestic appliances, such as, for example, dishwashers, etc., also designed to support further covering elements such as panels or the like.

The invention also relates to an electrical household appliance having a door and two respective hinges.

The refers purely by way of a non-limiting example to a front-opening household appliance such as a dishwasher.

The hinges used for the doors of domestic appliances normally consist of two elements kinematically connected to each other to move relative to each other in tilting fashion, and with a first of these elements fixed to the door and a second of these elements fixed to the frame of the electrical household appliance.

A lever is normally interposed between the above-mentioned first and second elements on which elastic elements act which can dynamically influence the opening/closing of the door.

In short, the main function of the elastic elements acting on the lever is to oppose the weight force of the door and substantially balance it so as to keep it stably open at any angle of opening and, above all, to prevent its weight from causing its falling when opened.

The prior art hinges of the type described have the drawback of requiring, in order to adapt to the possible different dimensions and weights of the doors, the replacement of the elastic elements in such a way as to guarantee that an effective balance is achieved for each door.

This problem has without doubt become worse over the years, with the success of electrical household appliances integrated in kitchen furniture and with the development of new covering materials, with a wide range of weights.

In fact, the same electrical household appliance can be combined, on the door, with different covering panels and these may be made of wood or its derivatives or of other materials, such as glass, resin, aluminium or composite materials.

In order to overcome this problem, hinges have been developed wherein the elastic elements have screw means for adjusting the preloading, which operate by varying the axial extension of a spring, which is typically helical.

These solutions have not been seen to be free from drawbacks.

A first drawback is connected to the need to make, for reasons of stability, an adjustment screw with the thread having a reduced angle of inclination and this translates into the fact that any adjustment requires a large number of rotations. This situation, that is to say, the laborious and long adjustment step, further implies that it is difficult to replicate exactly the same adjustment in both the hinges of the electrical household appliance, thus with the risk of implementing a system of forces that is not perfectly balanced and such as to cause malfunctions in the operations for opening and closing the doors.

The aim of the invention is to provide a hinge for doors which is able to overcome the drawbacks of the prior art and which is at the same time practical to use and simple and inexpensive to make.

A further aim of the invention is to provide a hinge for doors which is structurally simple and practical and effective to adjust.

According to the invention, these aims and others are achieved by a hinge for doors comprising the technical features described in the accompanying claims.

The technical features of the invention, according to the above-mentioned aims, are clearly described in the appended claims and its advantages are apparent from the detailed description which follows, with reference to the accompanying drawings which illustrate a non-limiting example embodiment of it, and in which;

Figure 1:
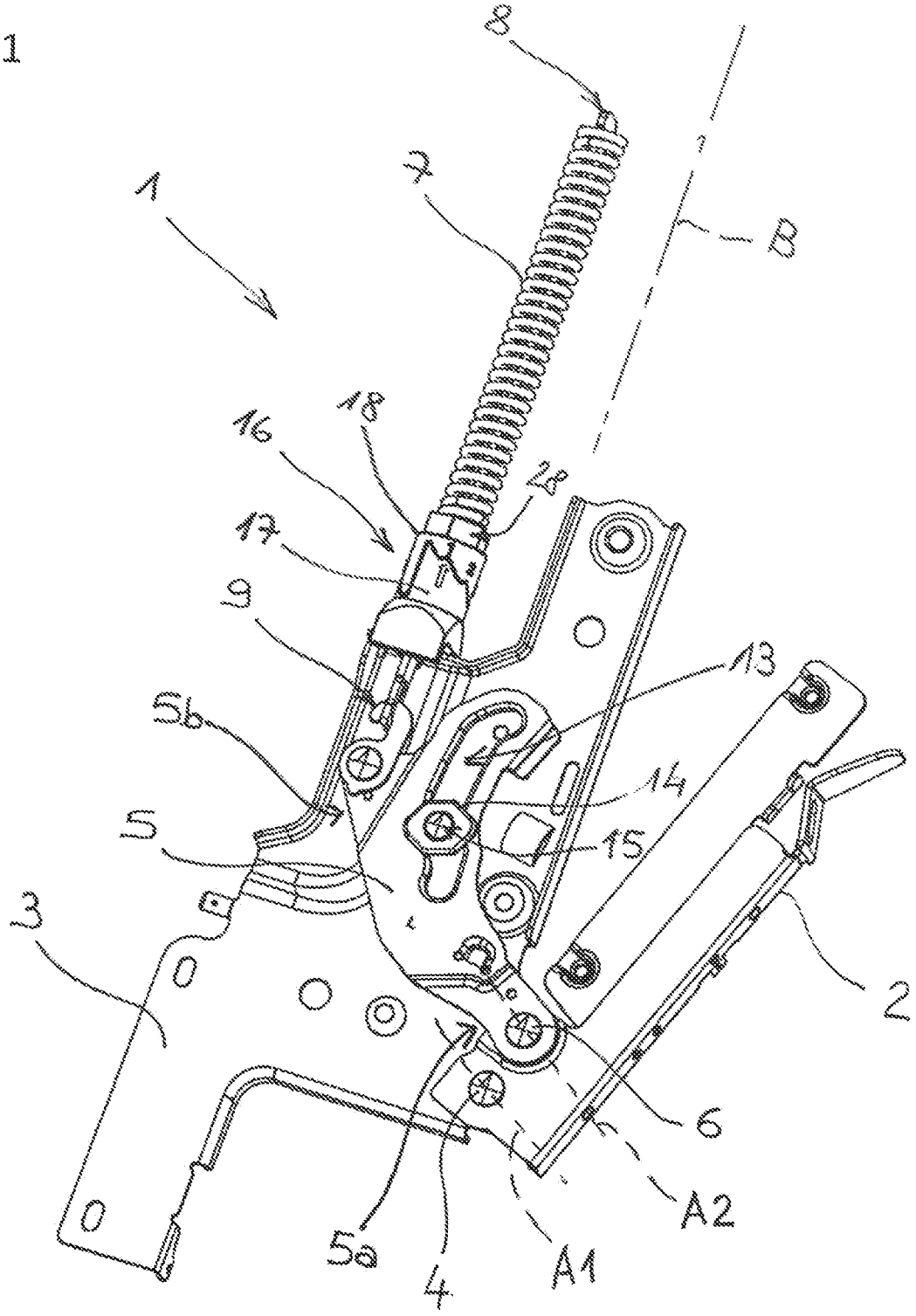
FIG. 1 is a schematic perspective view in a partly open position of a hinge for doors according to the invention.

As illustrated in FIG. 1, the numeral 1 denotes in its entirety a first embodiment of the hinge for doors according to the invention.

The hinge 1, paired with another one, is designed to be mounted on an electrical household appliance, such as a dishwasher, to connect the frame to the relative door, both not illustrated, in such a way that the latter is movable in a tilting fashion and, in other words, to render the door movable with respect to the frame between a closed position and an open position and vice versa.

With reference to the accompanying drawings, the hinge 1 comprises a first element 2 designed for fixing to the above-mentioned, not illustrated door of the electrical household appliance, and a second element 3, of a box-shaped type, designed for fixing to the above-mentioned, not illustrated frame of the electrical household appliance.

The first element 2 is pivoted to the second element 3 by a pin 4 to allow reciprocal rotation of the first and second elements 2, 3 about a respective axis of rotation A1.

The axis of rotation A1 defines the axis of rotation of the above-mentioned, not illustrated, door relative to the above-mentioned frame, also not illustrated.

The above-mentioned first and second elements 2 and 3 are kinematically connected to each other by a connecting lever 5.

At a relative first end 5*a*, the connecting lever 5 is pivoted to the first element 2 by a pin 6, in such a way as to rotate at least partly with respect to the first element 2 about a respective axis A2.

The hinge 1 also comprises a helical spring 7 and a drive rod 8 of the spring 7, both supported by the second, box-shaped element 3.

The drive rod 8 is engaged at the bottom by a hook 9.

The hook 9 is pivoted on the lever 5 at its second end 5*b*, opposite the above-mentioned first end 5*a*.

The drive rod 8 of the spring 7 is advantageously positioned inside the spring 7 and is connected to the top thereof, in known manner, so as to compress it, also according to substantially known methods.

Figure 2:
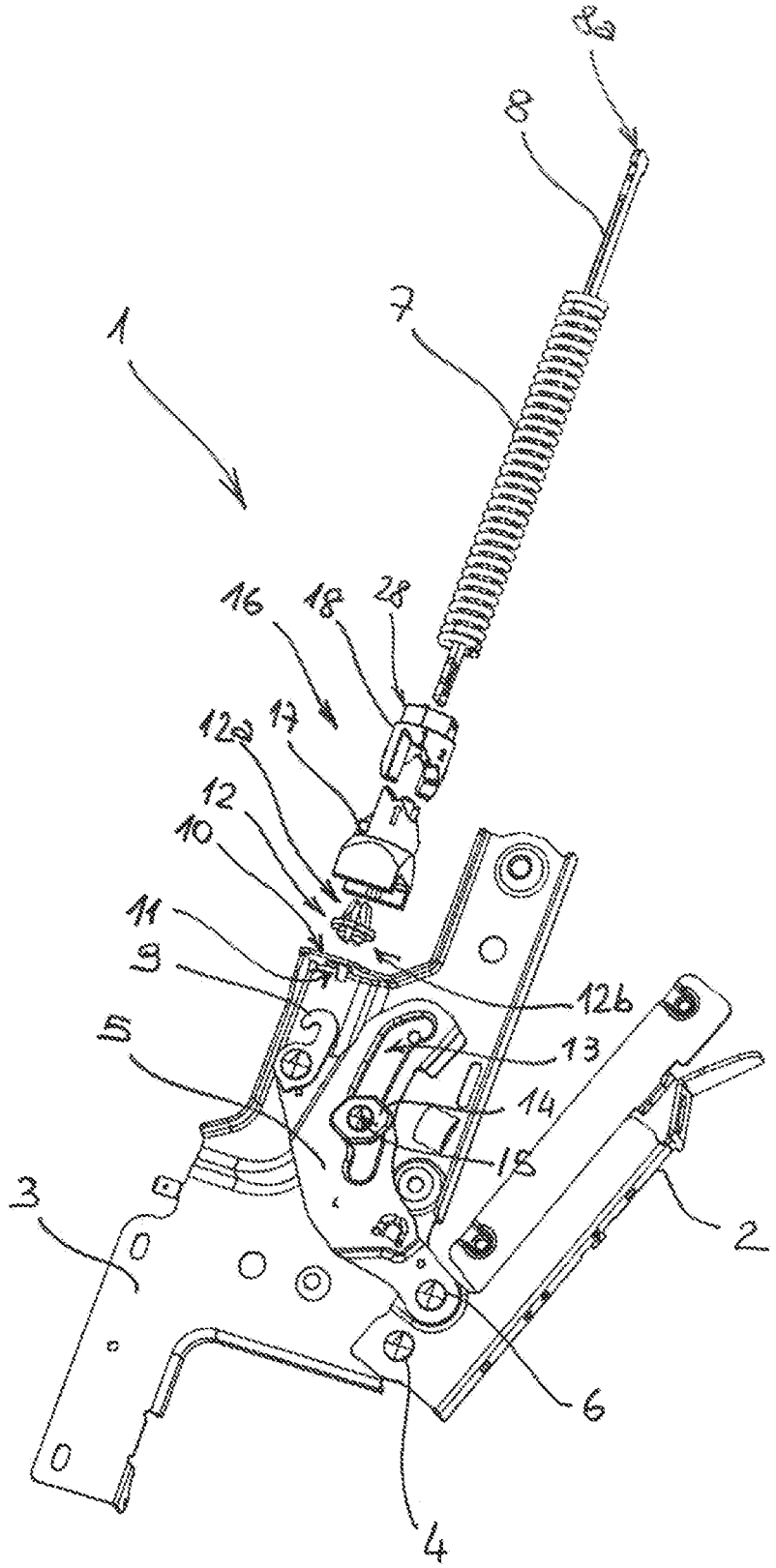
FIG. 2 is a partly exploded view of the hinge of FIG. 1.

In other words, as illustrated in FIG. 2, the drive rod 8 has an upper end 8*a* that is longitudinally opposite the end that is hooked to the lever 5, the upper end being designed to engage an upper end coil of the spring 7 in such a way as to compress the spring 7.

The spring 7 and the rod 8 extend along a main direction of extension B of the second box-shaped element 3.

The spring 7 defines, for the hinge 1, a respective elastic element designed to generate, with a relative deformation, an elastic reaction force designed to compensate at least partly for the weight force of the door during its opening or closing.

With reference to FIG. 2, the second, box-shaped element 3 has a bracket 10 extending in a plane perpendicular to the main plane of extension of the second element 3, a hole 11 being made on the bracket 10 for the passage of the drive rod 8.

The hinge 1 advantageously comprises a friction element 12, shown in FIG. 2, housed at the above-mentioned hole 11 and coaxial with it.

The friction element 12, of substantially known type, comprises an upper portion 12*a* with a tapered shape and a lower cylindrical portion 12*b* inserted in the above-mentioned hole 11 made in the bracket 10.

The upper portion 12*a* is divided into two lateral fingernail-shaped protrusions designed to superficially engage two opposite faces 8*a*, 8*b* of the rod 8 to apply a frictional action on it.

A slot 13 is made on the connecting lever 5.

The slot 13 slidably engages with its peripheral edge with a guide pin 14, integral with the second element 3 by means of a rivet 15.

Figure 3:
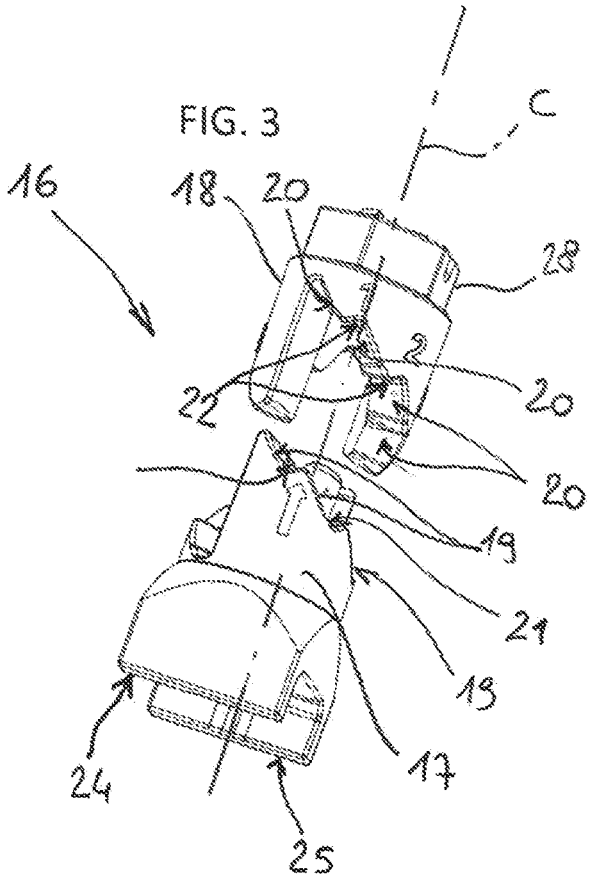
FIGS. 3 to 6 are respective schematic perspective views from different angles of details of the hinge of FIG. 2.

As illustrated in the accompanying drawings and in particular in FIGS. 2 and 3, the hinge 1 comprises a cylindrical cam device 16 interposed between the spring 7 and the second element 3.

With reference in particular to FIG. 3 which is shown in the exploded configuration, the cylindrical cam device 16 comprises a first lower cylindrical cam 17 and a second upper cylindrical cam 18.

The first and second lower and upper cylindrical cams 17, 18 will hereinafter also be referred to only as lower cam 17 and upper cam 18.

The cylindrical cam device 16 has a central axis C of extension also defining an axis of rotation for the reciprocal rotation of the two cylindrical cams 17, 18.

As shown in FIGS. 3 to 6, the first and second cylindrical cams 17, 18 have respective profiles having a succession of inclined portions 19, 20 alternated by respective depressions 21, 22.

Figure 5:
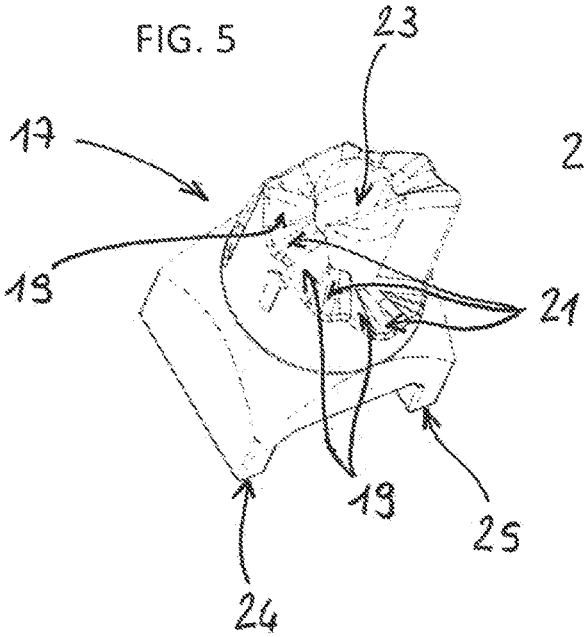

More in detail, as clearly illustrated in FIG. 5, the first lower cam 17 has inclined portions 19 alternated by depressions 21 whilst the second upper cam 18 has inclined portions 20 alternated by depressions 22.

The above-mentioned inclined portions 19, 20 of the profiles are designed to determine, for the device 16, by the rotation of one of the two cylindrical cams 17, 18 about the above-mentioned axis of rotation C, the translation of the other of the two cylindrical cams 17, 18 and vice versa.

The depressions 21, 22 are also designed to guarantee the maintaining of a stable reciprocal position of the first and second cylindrical cams 17, 18.

As illustrated in detail in FIG. 5, the first, lower cam 17 has a central through slot 23, shaped to match the drive rod 8.

The drive rod 8 is therefore free to slide longitudinally in the central slot 23 along the above-mentioned direction B whilst it is not free to rotate with respect to the first lower cam 17 about an axis parallel to the direction B.

Figure 6:
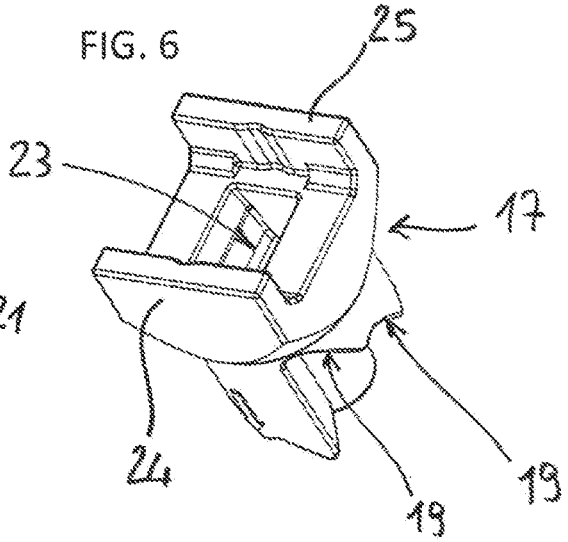

At a lower portion of it, illustrated in FIG. 6, the slot 23 has diverging inner faces designed to engage in contact with the above-mentioned fingernails of the upper portion 12*a* of the friction element 12.

As shown in FIG. 2, although in an exploded form, the friction element 12 is designed to be inserted partly into the central slot 23.

As clearly illustrated in FIGS. 1 and 3, the first, lower cam 17 also has two wings 24, 25 extending below and substantially parallel to each other.

The wings 24, 25 are designed to encircle on both sides the above-mentioned shelf 10, thus guaranteeing the stability of the first lower cam 17 with respect to the rotations about its central axis C.

Figure 4:
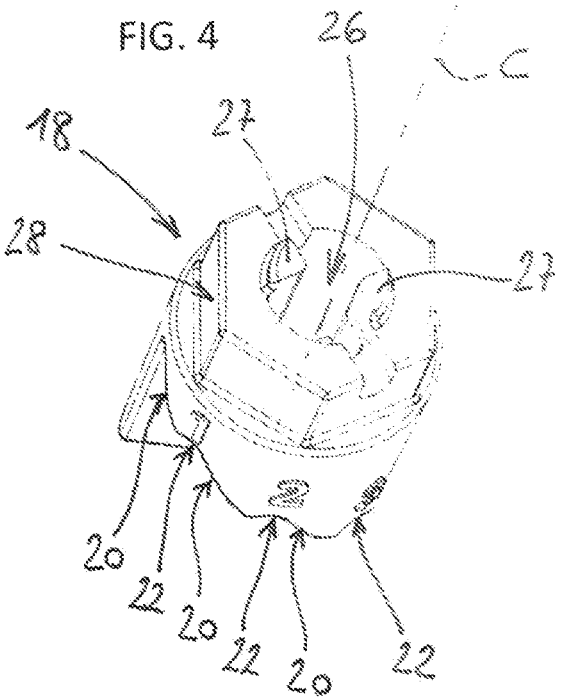

As illustrated in FIG. 4, the second, upper cam 18 has a central through hole 26, also designed for the passage into it of the control rod 8.

The central hole 26 is cylindrical in shape in such a way as to allow the relative rotation between the drive rod 8 and the second upper cam 18 with respect to the above-mentioned axis of rotation C.

At its upper opening, the hole 26 has two diametrically opposite triangular protrusions 27 designed to limit the reciprocal rotation between the drive rod 8 and the second upper cam 18.

Advantageously, the two triangular protrusions 27 are configured to limit the reciprocal rotation between the drive rod 8 and the second cam 18 greater than a maximum of 90 sexagesimal degrees.

At its upper end, the second upper cam 18 has a hexagonal portion 28 designed to define a zone for gripping and operating by a common key tool.

The hinges 1 illustrated and described herein are, in use, applied in pairs to an electrical household appliance, such as a dishwasher, having a door movable in a tilting fashion, located at lateral ends of the door.

Figure 7:
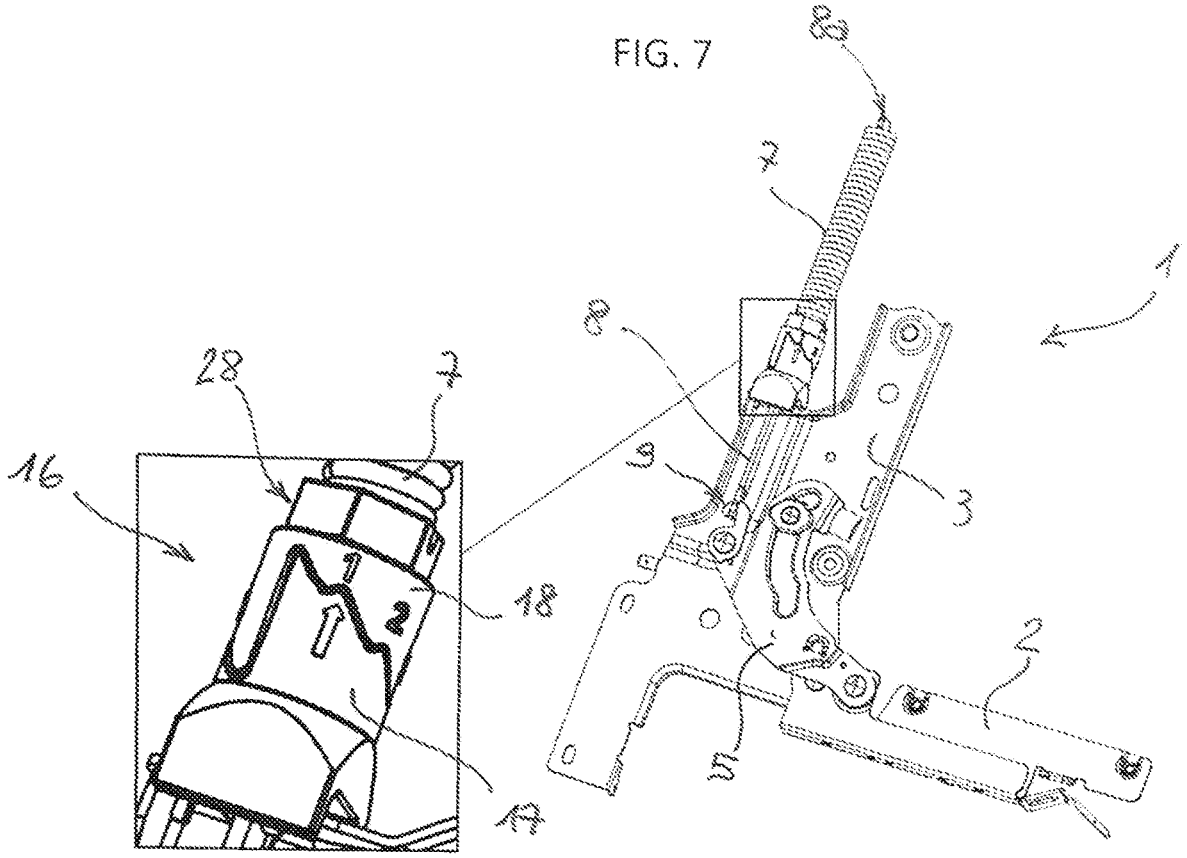
FIGS. 7 to 9 are respective schematic perspective views of the hinge of FIG. 1 in a relative fully open position in three different configurations of use.

With reference to FIG. 7, the hinge 1 is shown in an open configuration corresponding to a position in which the door, not illustrated, of the dishwasher is open.

As also clearly shown in the enlarged box, in the configuration of FIG. 4 of the hinge 1, the cylindrical cam device 16 has the two lower and upper cams 17, 18, closest to each other.

In short, all the inclined stretches 19, 20 of the respective profile of each cam 17, 18 are adjacent to a respective inclined stretch of the profile of the other cam 17, 18.

The fact that the two cylindrical cams 17, 18 are in the position closest to each other implies that the device 16 adopts its extension with the smallest possible size in the direction of its central axis C, thereby determining the condition of minimum preloading of the helical spring 7.

Under equal conditions of position of the drive rod 8, since the cylindrical cam device 16 is positioned in series with the helical spring 7 and together with the latter interposed between the upper end 8*a* of the drive rod 8 and the bracket 10, a relative dimensional variation in the direction of its central axis C results in varying the deformation of the spring 7 and, therefore, in other words, its preloading.

In fact, as known, in a spring, the intensity of the elastic reaction force of the spring is a function both of the relative elastic constant of the spring and of the deformation to which the spring is subjected. In the example illustrated in the accompanying drawings, the helical spring 7 extends longitudinally along the direction B (parallel to the axis C) and the deformation to which the spring 7 is subjected is a compression along that direction.

Figure 8:
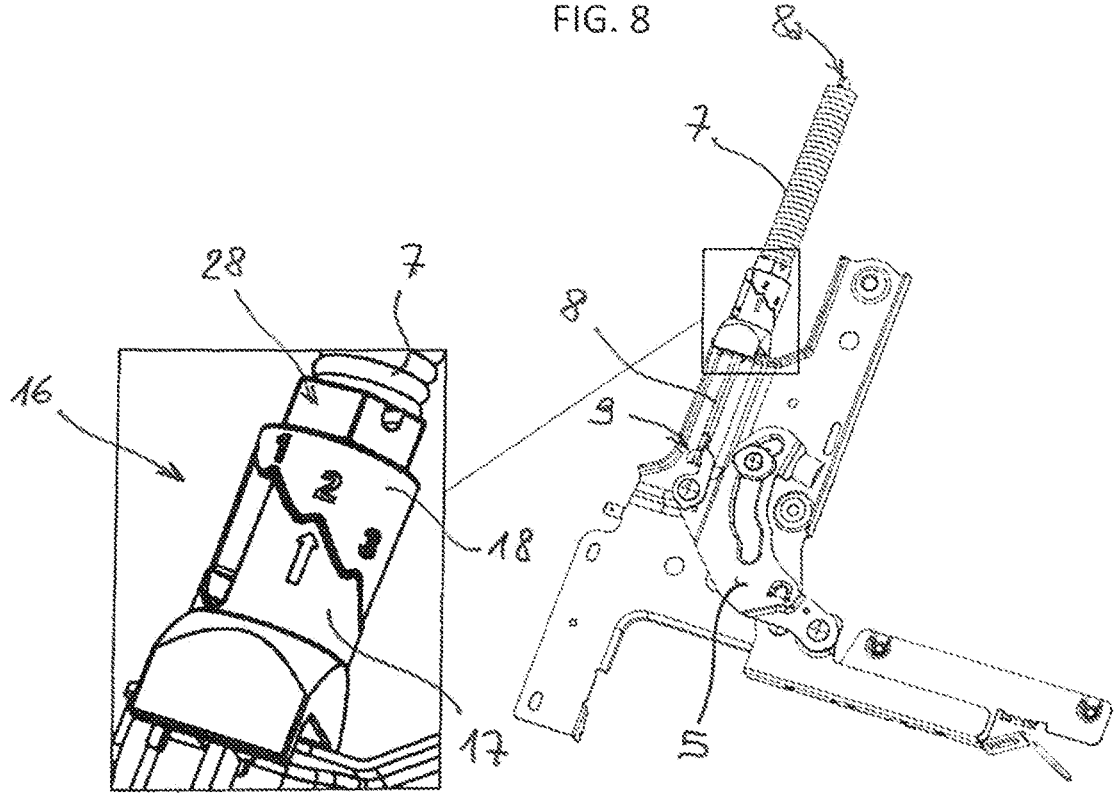

Starting from the configuration adopted by the device 16 in FIG. 7, using a hexagonal control key engaged in the hexagonal portion 28 of the second upper cam 28 and rotating the latter by approximately 45 sexagesimal degrees it is possible, overcoming the elastic reaction force of the spring 7, to move the two cylindrical cams 17, 18 away from each other until reaching a new stable position, visible in the enlargement of FIG. 8.

Basically, as indicated by the arrow present on the outer surface of the first lower cam 17 and by the numerals imprinted on the upper cam 18, the rotation described above makes it possible to carry the number 2 imparted on the second cam 18 to the above-mentioned arrow.

Engaging with an operating key the hexagonal portion 28 of the second upper cam 18 and rotating the latter does not cause the simultaneous rotation of the first lower cam 17 since the latter is prevented from rotating thanks to the engagement of the wings 24, 25 with the bracket 10.

The moving away of the two cylindrical cams 17, 18 therefore causes an increase in the overall size of the cylindrical cam device 16 in the direction of its axis C and, consequently, a compression of the helical spring 7.

As described above, the compression of the helical spring 7 causes an increase in the elastic reaction force generated by the spring 7.

This increase in the elastic reaction force of the helical spring 7 allows the hinge 1 in the configuration of FIG. 8 to balance the doors which are heavier compared with those which would have balanced in the relative configuration of FIG. 7, that is to say, with a lower preloading.

Figure 9:
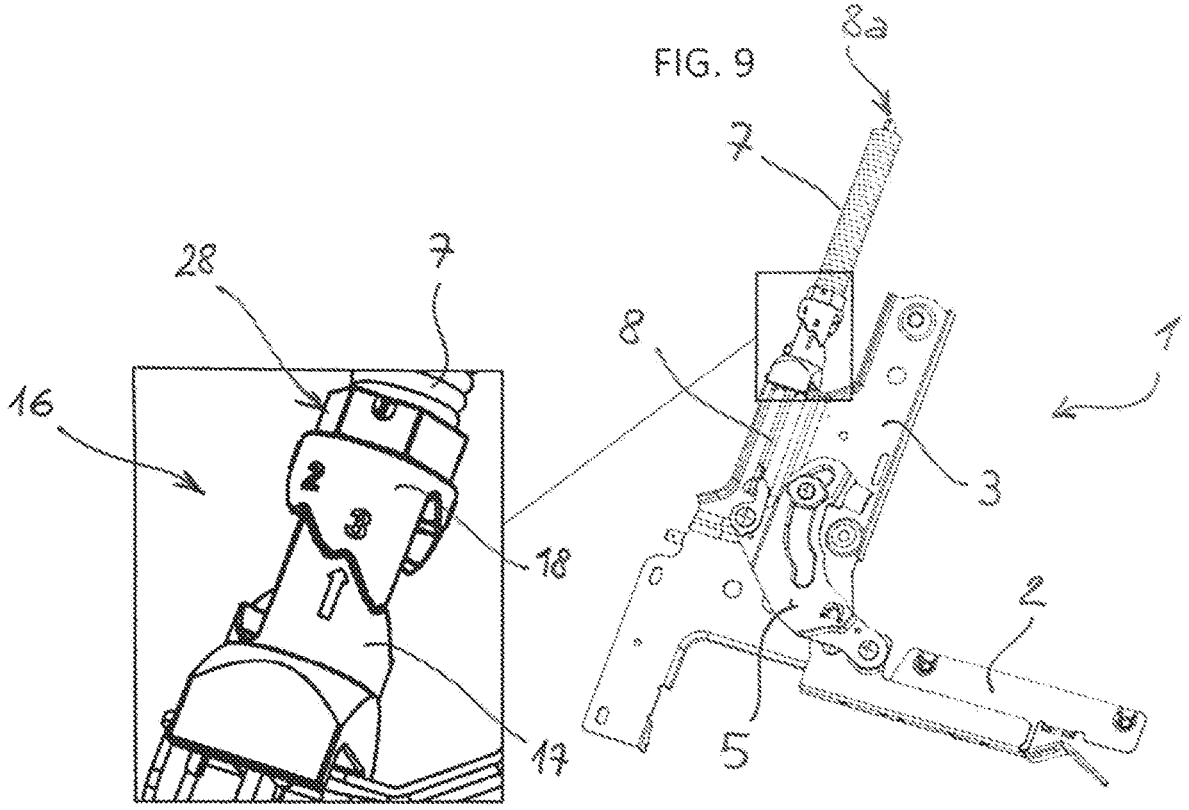

The passage of the cylindrical cam device 16 between the configuration of FIG. 8 and that of FIG. 9 is identical to that described above and comprises the further reciprocal rotation by 45 sexagesimal degrees between the two cylindrical cams 17, 18.

Upon reaching the configuration of the cylindrical cam device 16 illustrated in FIG. 9, the device is further developed in the direction of its central axis C, thereby causing a further compression of the helical spring 7 and, consequently, a greater elastic reaction force is exerted by the latter.

Very briefly, with the cylindrical cam device 16 in the configuration of FIG. 9, wherein the number 3 is located at the arrow present on the first lower cylindrical cam 17, the two cylindrical cams 17, 18 adopt a position further away from each other, reaching the maximum compression of the helical spring 7 and, consequently, the maximum value of the elastic reaction force of the spring.

The above-mentioned cylindrical cam device 16 thus defines, for the hinge 1, respective means for adjusting the intensity of the elastic reaction force exerted by the helical spring 7.

Figure 10:
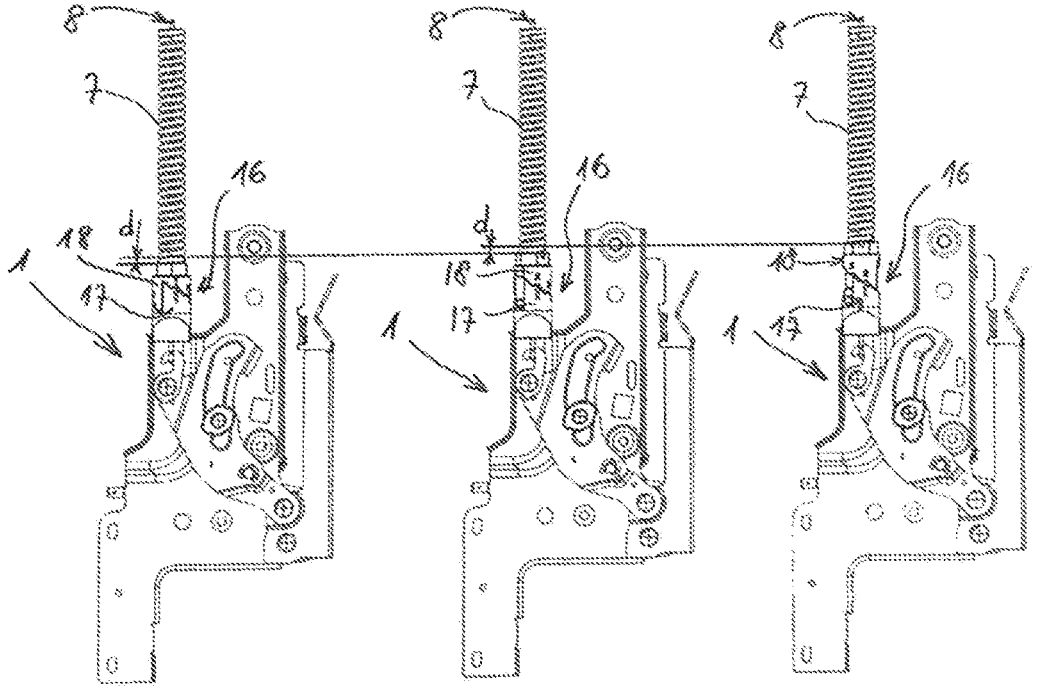
FIG. 10 is a respective side elevation view of the hinge according to the invention in the three configurations of FIGS. 7 to 9, in the closed position.

FIG. 10 schematically illustrates in a comparative manner three different configurations adopted by the cylindrical cam device 16.

Between the first configuration on the left and the central configuration, which then represent the reciprocal position of the two cylindrical cams 17, 18 already illustrated in FIGS. 7 and 8, respectively, the increase in extension in the direction of the axis C obtained with the rotation of 45 sexagesimal degrees of the second cam 18 relative to the first cam 17 is represented in the drawing by the distance "d".

The same distance "d" represents the increase in extension in the direction of the axis C obtained with the further rotation by 45 sexagesimal degrees of the second cam 18 with respect to the first cam 17 in the passage between the respective reciprocal positions illustrated, respectively, in FIGS. 8 and 9.

The hinge 1 according to the invention is therefore able to perform three different balancing actions, gradually increasing according to the three different configurations adopted by the cylindrical cam device 16.

The hinge 1 for doors according to the invention achieves the preset aims and brings important advantages.

A first advantage is due to the fact that by means of the hinge 1 according to the invention, it is advantageously possible to modify in a fast and effective manner the intensity of the elastic reaction force of the helical spring 7 and, consequently, the intensity of the balancing action applied on the door, by means of a simple adjustment operation actuated on the cylindrical cam device 16.

A further advantage is due to the possibility of easily integrating, in the cylindrical cam device 16, a friction element thereby achieving both a very practical application during assembly and a reduction in dimensions since one is substantially contained in the other.

Again advantageously, at the same time as the compression of the helical spring 7, there is a greater proportional approach between the friction element 12 and the inner faces of the slot 23. Consequently, this coupling is also adjusted according to the different configurations adopted by the cylindrical cam device 16 and causes the reaction force developed by the hinge 1 to vary as a function of the different interference between the friction element 12 and the first lower cylindrical cam 17.

The resulting interference develops a friction force on the drive rod 8 which advantageously allows the hinge 1 to balanced in such a way as to cover a larger range of weights.

The use of alternative types of springs different from the helical ones is to be considered, for the purposes of the invention, to be considered as simply a technical equivalent if the springs are in any case capable of deforming by compression and increasing its elastic reaction force if compressed.

An example of equivalent alternative springs consists of cup-shaped springs.

The invention claimed is:

1. A hinge for a door of an electrical household appliance, comprising:

a first element and a second element pivoted to each other and movable relative to each other in a tilting manner, said first and second elements being fixable one to a frame and the other to a door of an appliance, to make the door movable with respect to the frame between a closed position and an open position, a connecting lever connected between said first and second elements, an elastic element connected between said connecting lever and at least one of said first and second elements and capable of generating, by deformation of the elastic element, an elastic reaction force to compensate at least partially a weight force of the door during its-opening or closing of the door, an adjusting mechanism operatively connected with the elastic element and configured to adjust the deformation of the elastic element to adjust an intensity of said elastic reaction force, said adjusting mechanism including a cylindrical cam device configured to assume a first plurality of different configurations in correspondence of which said elastic element also assumes the first plurality of different deformed configurations, wherein said cylindrical cam device comprises a first lower cylindrical cam and a second upper cylindrical cam, said first lower and second upper cylindrical cams including respective profiles having a succession of inclined portions spaced by depressions, said first lower cylindrical cam and said second upper cylindrical cam being movable relative to one another to provide the first plurality of different configurations.

2. The hinge according to claim 1, and further comprising a drive rod for driving said elastic element, wherein said first lower cylindrical cam has a central passing-through slot, inside of which central passing-through slot said drive rod is free to slide longitudinally according to a determined direction.

3. The hinge according to claim 2, wherein said central passing-through slot is counter-shaped with respect to said drive rod to prevent mutual rotation of said drive rod and said first lower cylindrical cam about an axis parallel to said determined direction.

4. The hinge according to claim 3, wherein said second upper cylindrical cam has a central passing-through hole suitable for the passage of said drive rod therein.

5. The hinge according to claim 4, wherein said central passing-through hole has at least a partially cylindrical arrangement, wherein said central passing-through hole has two diametrically opposed triangular projections, configured to limit a mutual rotation between said drive rod and said second upper cylindrical cam around the axis parallel to said determined direction.

6. The hinge according to claim 2, and further comprising a friction element interposed between said second element and said cylindrical cam device and operatively active on said drive rod to exert a friction action on the drive rod.

7. The hinge according to claim 2, wherein said second upper cylindrical cam has a central passing-through hole suitable for the passage of said drive rod therein.

8. The hinge according to claim 1, wherein said first lower cylindrical cam has two wings protruding inferiorly, said two wings being suitable to bilaterally embrace a portion of said second element, to ensure a stability of said first lower cylindrical cam with respect to rotations around an axis of the first lower cylindrical cam central with respect to said second element.

9. The hinge according to claim 1, wherein said second upper cylindrical cam has a hexagonal portion configured to define a gripping and actuating zone for a key tool.

10. The hinge according to claim 1, wherein said elastic element comprises a helical spring.

11. A household appliance comprising a door movable in tilting fashion, comprising a pair of the hinge according to claim 1.

* * * * *